US005245802A

United States Patent [19]

Davis

[11] Patent Number: 5,245,802

[45] Date of Patent: Sep. 21, 1993

[54] PORTABLE COLLAPSIBLE BUILDING SYSTEM

[76] Inventor: James P. Davis, P.O. Box 11394, Bainbridge Is., Wash. 98110

[21] Appl. No.: 765,991

[22] Filed: Sep. 26, 1991

[51] Int. Cl.[5] ..... E04B 1/32

[52] U.S. Cl. ..... 52/86; 52/36.4; 52/641; 135/97

[58] Field of Search ..... 52/86, 80, 92, 36, 90, 52/639, 641, 644, 63, 93; 135/97, 101, 106

[56] References Cited

U.S. PATENT DOCUMENTS

| | | | |
|---|---|---|---|
| 34,258 | 1/1862 | Lynch | 135/109 |
| 128,542 | 7/1872 | Guthrie | 135/109 |
| 627,100 | 6/1899 | Conn | 135/109 |
| 838,689 | 12/1906 | Comstock | 135/97 |
| 882,875 | 3/1908 | Diehl | 135/109 |
| 925,059 | 6/1909 | Walker | 135/109 |
| 1,178,734 | 4/1916 | Kranse | 135/109 |
| 1,291,758 | 1/1919 | Buck | 135/109 |
| 1,295,713 | 2/1919 | Drohovith | 135/109 |
| 1,494,050 | 4/1924 | Wittman | 135/97 |
| 1,730,267 | 10/1929 | Chittim | 135/109 |
| 1,825,183 | 9/1931 | Frisby | 135/97 |
| 1,892,378 | 12/1932 | Bernstein | 135/97 |
| 1,926,159 | 9/1933 | McKee | 52/639 |
| 2,277,021 | 3/1942 | Lynn | 135/97 |
| 2,363,917 | 11/1944 | Waterman | 135/1 |
| 2,523,195 | 9/1950 | Comber | 135/904 |
| 2,640,999 | 6/1952 | Sheppard | 135/904 |
| 3,042,978 | 7/1962 | Eames et al. | 312/245 |
| 3,474,802 | 10/1969 | Loring | 135/1 |
| 3,536,083 | 10/1970 | Reynolds | 135/1 |
| 3,566,554 | 3/1971 | Schaffer | 52/79.5 |
| 3,828,492 | 8/1974 | Schlieman et al. | 52/86 X |
| 3,945,157 | 3/1976 | Borys | 52/79.5 |
| 3,974,602 | 8/1976 | Pohl et al. | 52/93 |
| 4,186,666 | 2/1980 | Honickman | 52/86 X |
| 4,194,328 | 3/1980 | Pierson et al. | 52/86 |
| 4,270,816 | 6/1981 | Erickson | 135/5 |
| 4,569,163 | 2/1986 | Long | 52/36 |
| 4,802,500 | 2/1989 | Davis | 135/97 |
| 4,894,962 | 1/1990 | Conn | 52/86 |
| 4,907,383 | 3/1990 | Winter, IV | 52/86 |

*Primary Examiner*—Carl D. Friedman
*Assistant Examiner*—Kien Nguyen

[57] ABSTRACT

A portable building system of variable size (20) consisting of a series of individually collapsing web beam frames (22) which serve simultaneously as a support structure for the exterior covering material (30) and as a support structure for a highly adaptable interior furnishing system. Individual web beam frames (22) are comprised of multiple segments including vertically oriented outer segments (32) which have a width measured horizontally in the plane of their span sufficient to support furnishing components 26 substantially within an area directly between a pair of consecutive outer frame segments 32 in a strong and convenient manner. Additional overhead segments (34) are joined to each other and to outer segments (32) with corresponding mortise (36) and tenon (38) like surfaces for a fast and positive assembly. Purlins (24) attach to the frames, joining them in sequence. Individual bays are formed between the wide vertical outer segments (32) of any two sequential frames (22) and these bays are then easily customized with the desired interior furnishing components (26) such as desks, counters, shelves, benches, bunks, and tables. Horizontal furnishing components (26) may be optionally installed at various heights between the opposing surfaces of the wide outer segments (32) of any two consecutive web beam frames. The furnishing components (26) once installed thereby become integral to the overall structure of the building. The purlins (24) also provide support for optionally used insulating liners (44) which are independent of the primary exterior cover.

9 Claims, 12 Drawing Sheets

PORTABLE COLLAPSIBLE BUILDING SYSTEM

FIELD OF INVENTION

This invention relates to the field of portable building systems and more particularly to the field of collapsible building systems which when erected provide an adaptable interior furnishing system which is integral to the structure of the building itself.

BACKGROUND ART

Typical applications for portable collapsing building systems such as, berthing areas, kitchens, medical, communications, or storage facilities are all highly dependant on interior components such as shelves, counters, tables, workbenches, bunks and benches etc. in order to allow an efficient use of available interior space. The importance of interior furnishings or more generally of a functional interior layout are often overlooked or compromised in the design of portable collapsible buildings. While there are a great many designs in existence which address the objectives of collapsibility and ease of transport quite well, particularly fabric covered structures, most of these are simply covering systems which make no provision for and must be treated entirely independently of interior furnishings.

If a large number of interior furnishings are required for a desired application and these furnishings must be both transported and also structurally supported independently of the building structure then their weight and bulk will offset much of the advantage of using a lightweight easily transported building structure.

The prior art which demonstrates furnishings that are in some way supported by the framework of the structure or which are integral to the structure typically requires that the furnishing components remain in a fixed location within the building allowing the user very little flexibility in customizing the interior for their own unique needs. It is doubtful that any one fixed interior layout can provide the maximum effective use of interior space for more than one specific type of application. Allowing the user as much flexibility as possible in arranging the layout of interior furnishings provides the greatest potential of maximizing the effective use of interior space for the broadest range of applications.

Additionally the designs with the highest strength to weight ratios such as dome shaped structures, Quonset shaped structures or all structures with inwardly sloping sides often sacrifice usable wall space, standing room or effective storage or work space near the perimeter of the building thereby forcing an awkward use of general interior space. While many of these structures are lightweight, easily transported, easily erected, and also have the strength to withstand use in harsh environments, a simple square foot measurement of floor area is not an accurate measure of the functional space they provide.

Structures which do provide full vertical clearance at their interior perimeter or which do have flat vertical walls suitable for supporting shelves or for partially supporting other interior components are typically either heavier and bulkier to transport such as rigid wall collapsing panel structures or they are very lightly framed such as wall tents or vertically sided pipe framed fabric structures which do not have the strength to withstand use in harsh environments with heavy wind and snow loads.

Still furthermore, very few designs allow for the easy and fast customization of the type and depth of insulation used for each application every time the structure is erected or while the structure is in use.

Other problems typically observed in the prior art include designs which;

(a) are difficult to assemble;

(b) require special tools or equipment to assemble;

(c) involve a large number of parts or involve complex parts making the structure difficult to manufacture, more vulnerable to failure and more difficult to repair in the field.

Among the patented prior art devices of which the applicant is aware are the following U.S. patents:

U.S. Pat. Nos. 34,258; 128,542; 627,100; 838,689; 882,875; 925,059; 1,178,734; 1,291,758; 1,295,713; 1,494,050; 1,730,267; 1,825,183; 1,892,378; 1,926,159; 2,227,020; 2,363,917; 2,523,195; 2,640,999; 3,474,802; 3,536,083; 3,566,554; 3,828,492; 3,945,157; 4,186,666; 4,194,328; 4,270,816; 4,569,163; 4,802,500; 4,894,962; 4,907,383;

None of the cited prior patents is pertinent in terms of its structure or construction principles to the invention herein other than for isolated features.

OBJECTS AND ADVANTAGES

Accordingly it is among the many objects and advantages of my invention to provide a portable collapsible building system of novel configuration which;

(a) allows the user to maximize the function of interior space for a wide variety of applications through the use of a highly adaptable interior furnishing system which is supported by and integral to the support structure of the building itself;

(b) allows for the effective use of all interior space including the full perimeter of the interior;

(c) is both lightweight yet strong enough to be used in harsh environments where heavy wind and snow load conditions are present;

(d) allows for an optional insulation system which is both easily and quickly installed and can be easily and quickly customized with various depths and types of insulation either during or anytime after the building is erected according to changing needs or applications;

(e) is compact and easy to transport when in a collapsed condition;

(f) is easy and fast to erect with as few as two people and without the need for any tools or equipment which is not integral to the structure itself;

(g) may be easily manufactured out of a wide variety of materials, including but not limited to the great variety of rigid sheet materials now available, using a small number of standard patterns;

(h) is extendable lengthwise indefinitely with the addition of standard components.

All of the above listed objects and advantages are effectively achieved through the novel configuration of components defined by the invention herein. It should be noted that the overall simplicity of the design is among the primary objectives of this invention. The ease of manufacture, the ease of assembly, reliability and ease of repair in the field are all enhanced and facilitated by the simplicity achieved in this invention. Further objects and advantages of my invention will become apparent from a consideration of the drawings and ensuing description of it.

REFERENCE NUMERALS IN THE DRAWINGS

Figure 1:
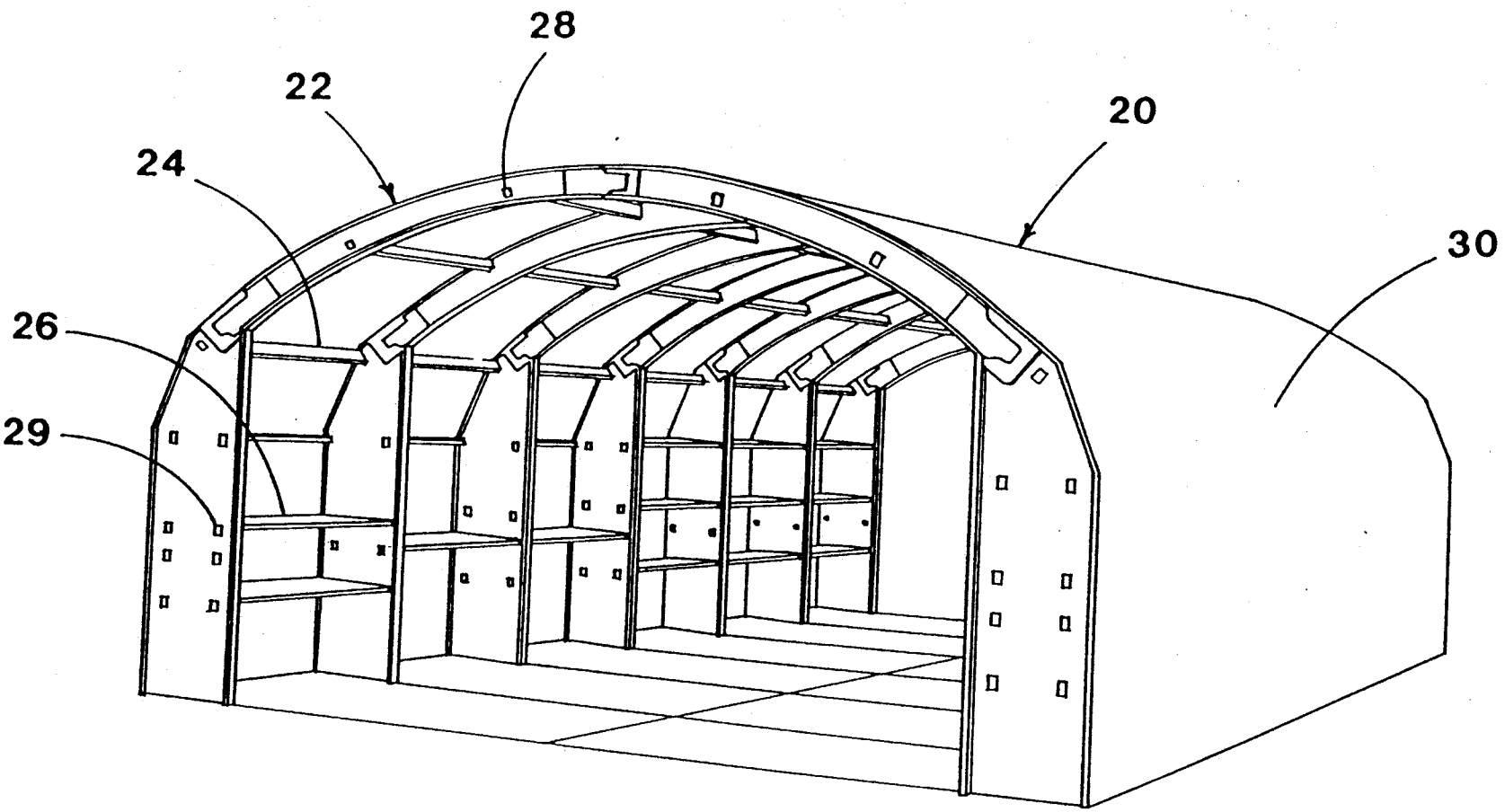
FIG. 1 is an overall perspective view of the building with one endwall removed to reveal the interior structure.

20 entire structure
22 individual web beam frames
24 purlins
26 horizontal furnishing components
28 purlin receiving hardware
29 furnishing component receiving hardware
30 external covering means
32 vertically oriented outer frame segments
33 inner web beam flanges
34 overhead frame segments
35 outer web beam flanges
36 mortise
38 tenon
39 webbing
40 purlin tab hardware
44 insulating liners
46 end wall
48 door means
50 guy lines

DESCRIPTION

Figure 2:
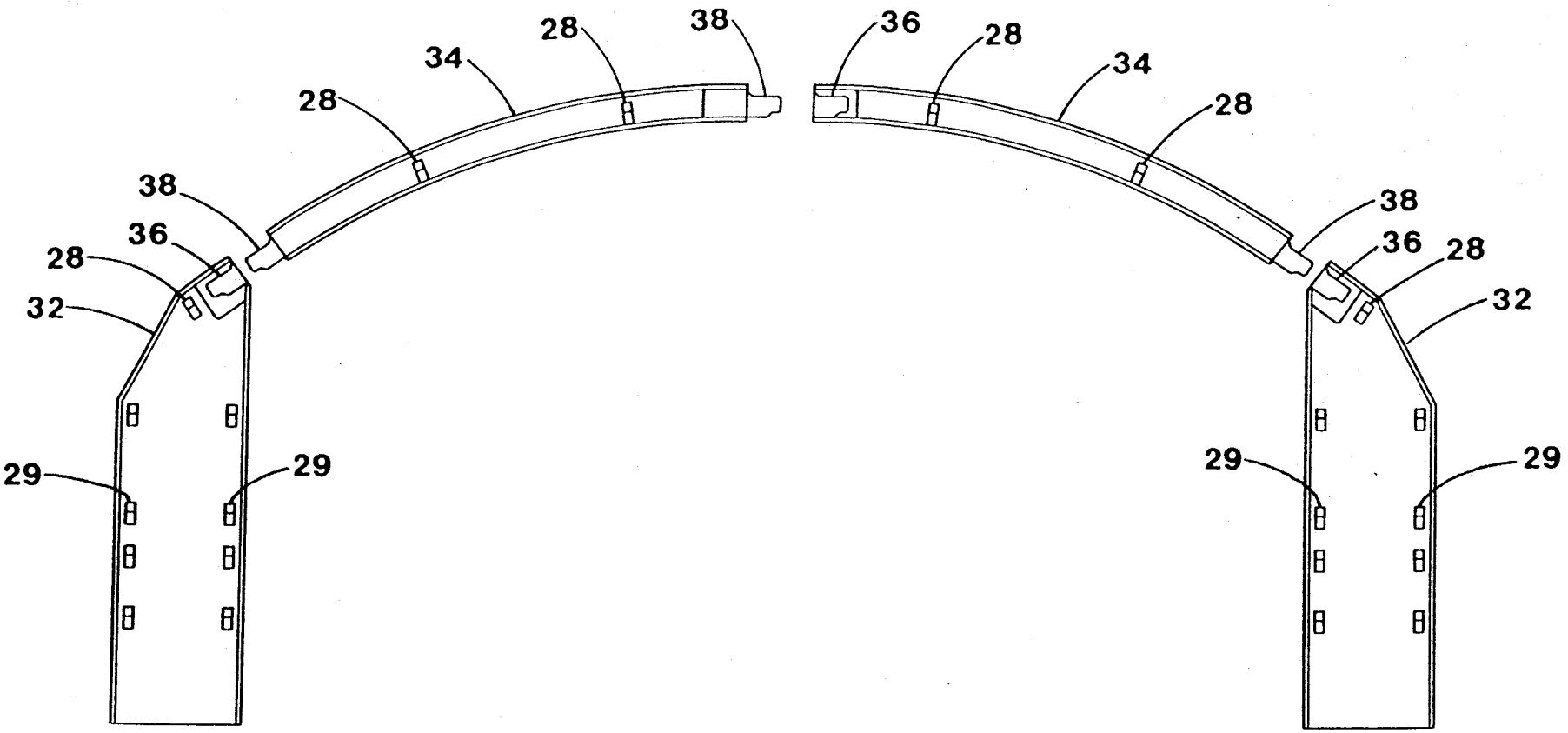
FIG. 2 shows a single web beam frame in an assembled condition.
Figure 3:
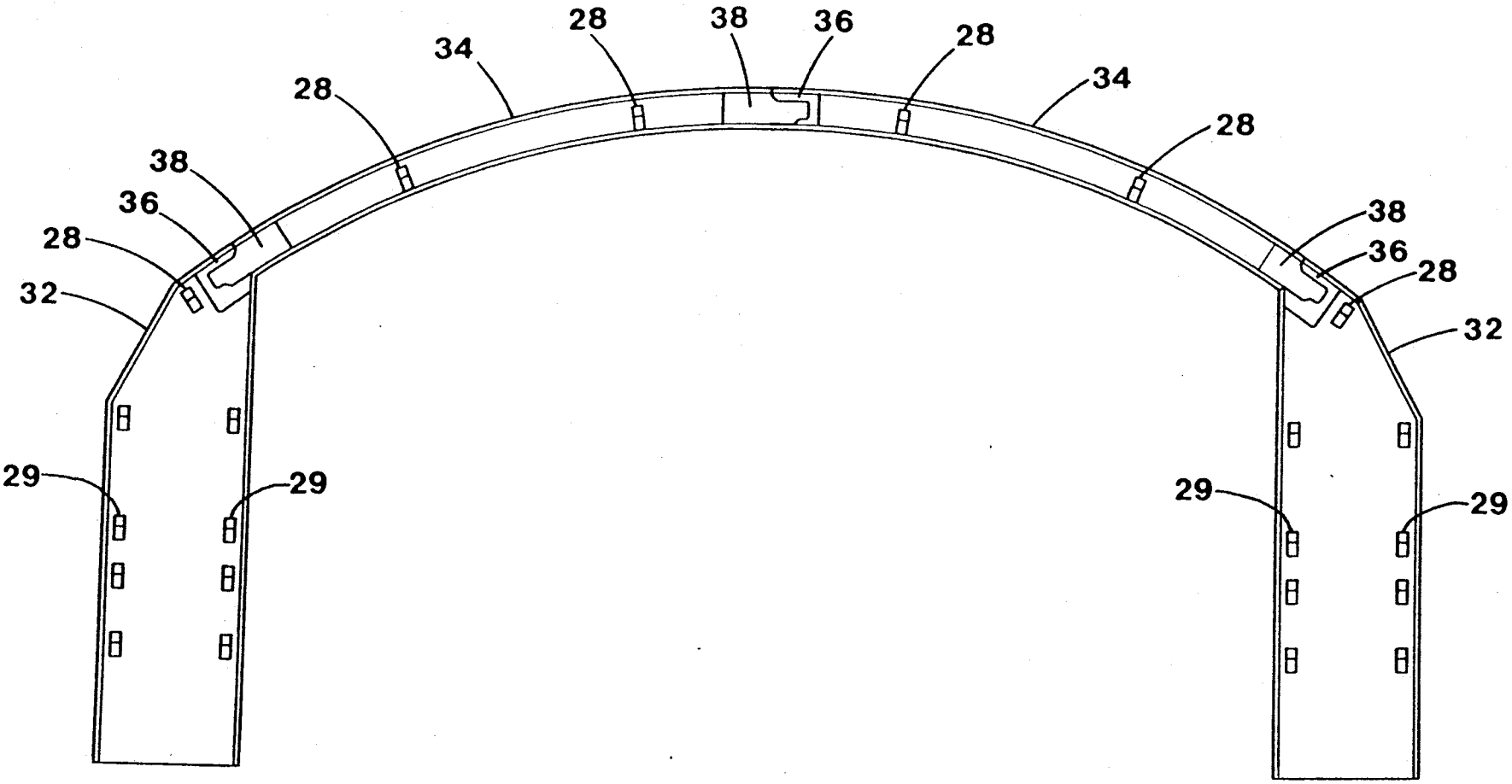
FIG. 3 shows the individual components of a single web beam frame in an exploded view.
Figure 4:
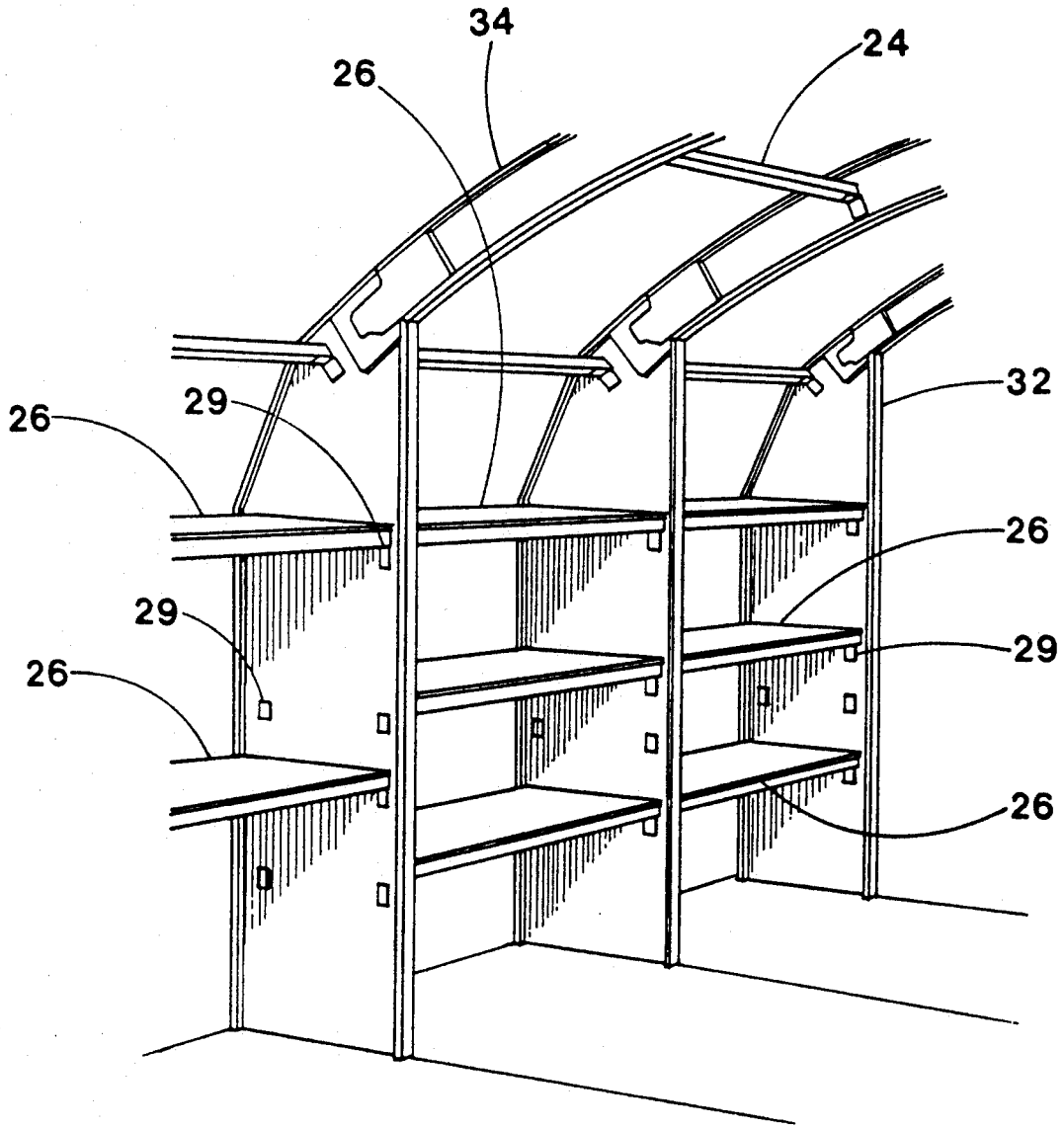
FIG. 4 illustrates a typical furnishing configuration.
Figure 5:
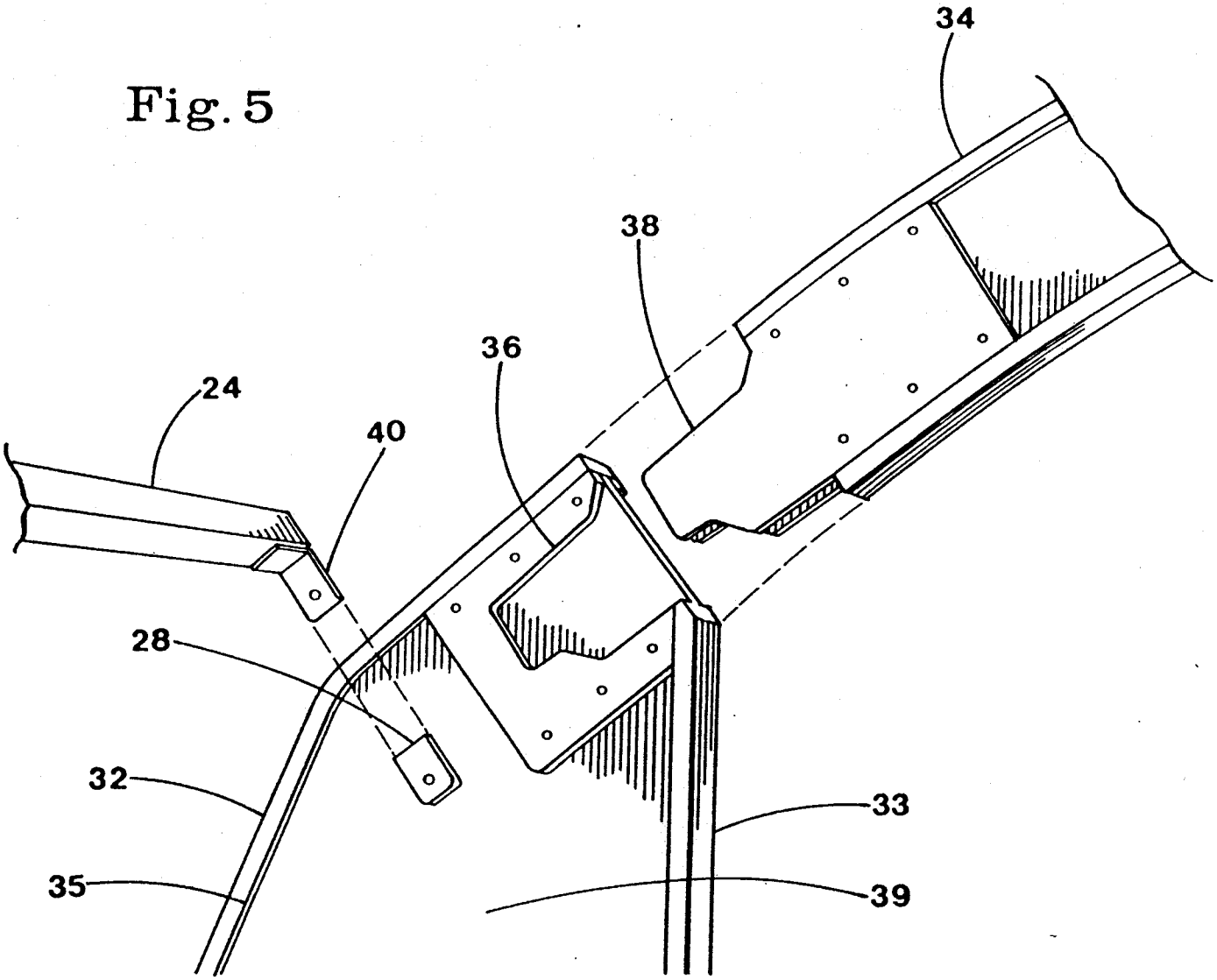
FIG. 5 is an exploded view of the corresponding mortise and tenon surfaces of a vertical outer segment and an overhead segment of a web beam frame as well as of a purlin and its corresponding receiving hardware.
Figure 6:
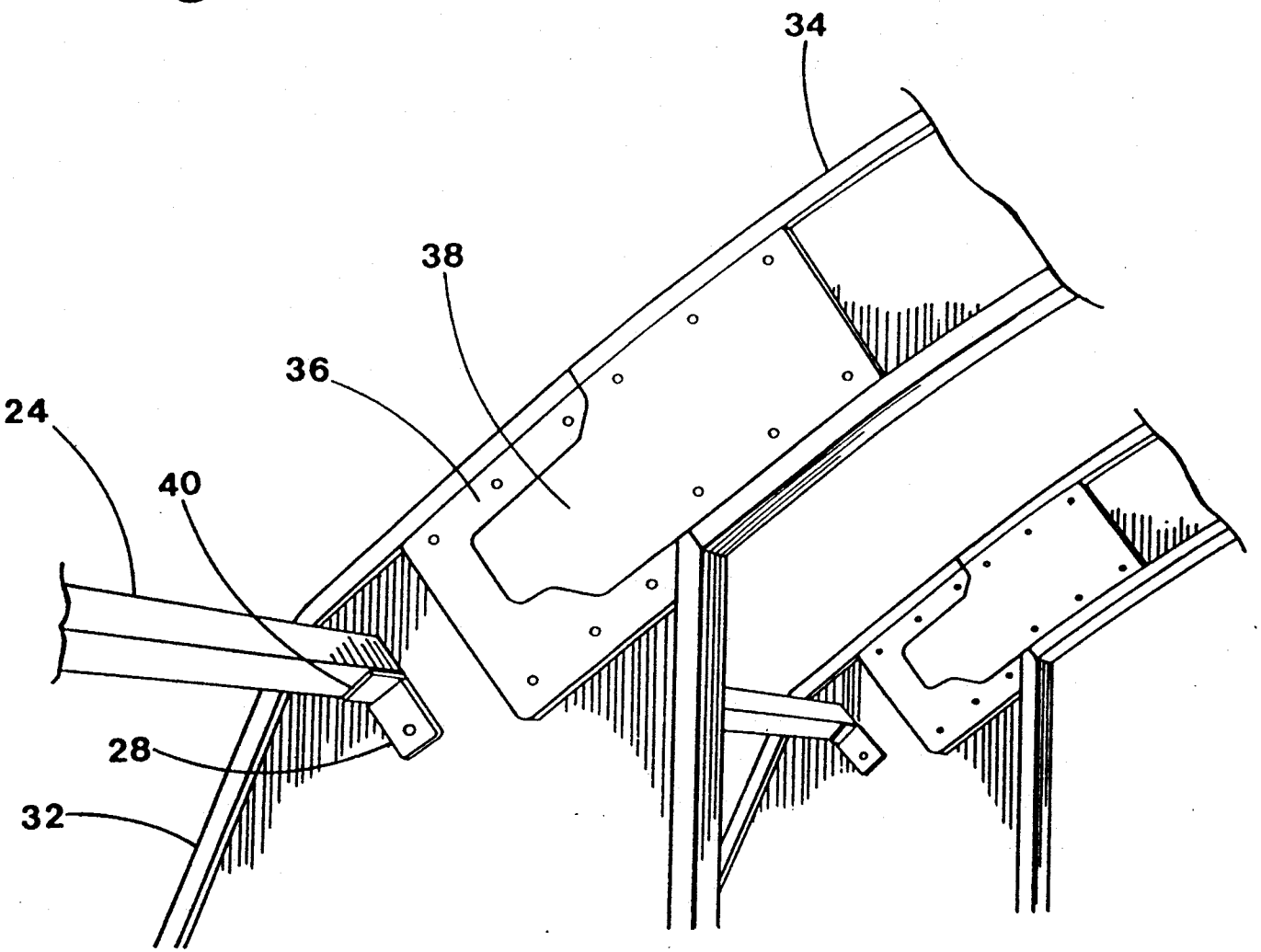
FIG. 6 shows the components of FIG. 5 in an assembled condition.
Figure 7:
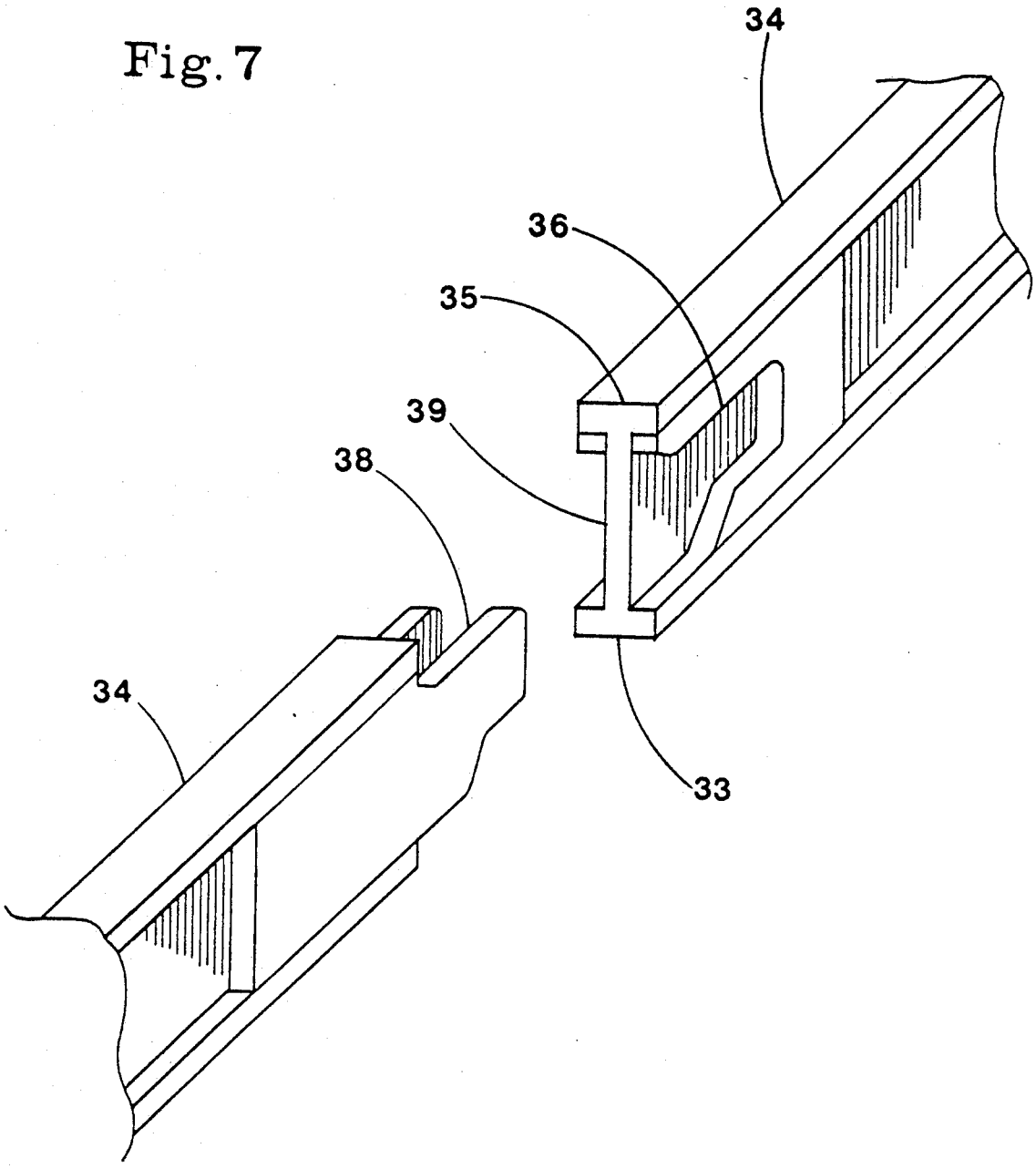
FIG. 7 is an exploded view of the mortise an tenon surfaces of overhead frame segments.
Figure 8:
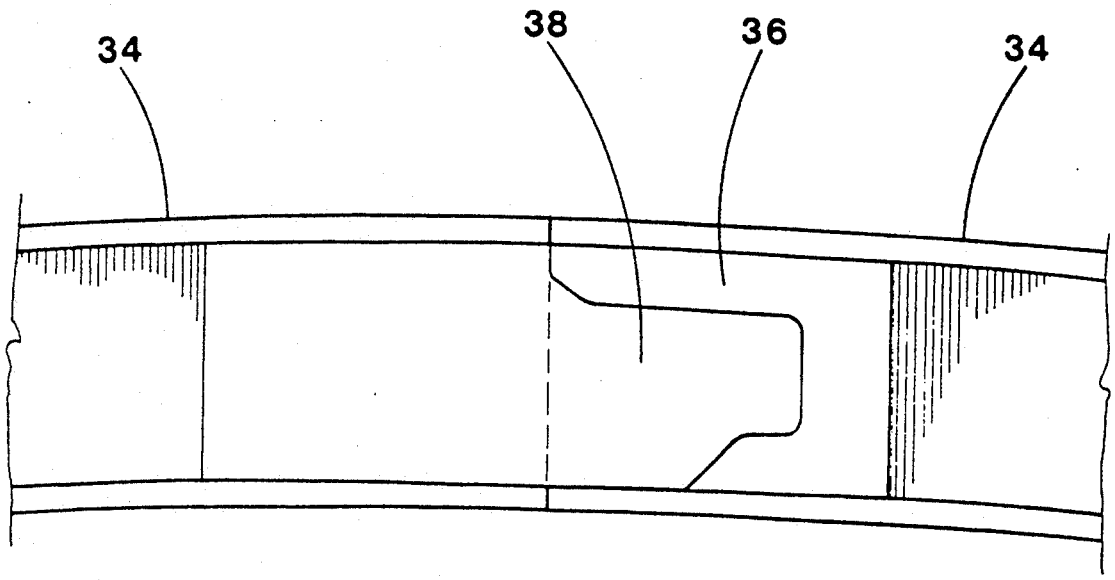
FIG. 8 shows the components of FIG. 7 in an assembled condition.
Figure 10:
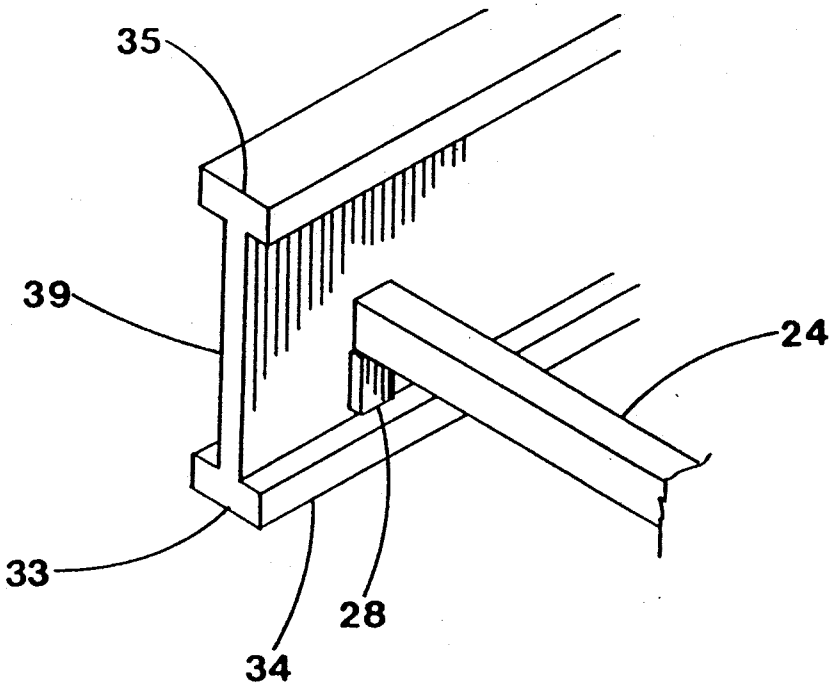
FIG. 10 shows the components of FIG. 9 in an assembled condition.
Figure 9:
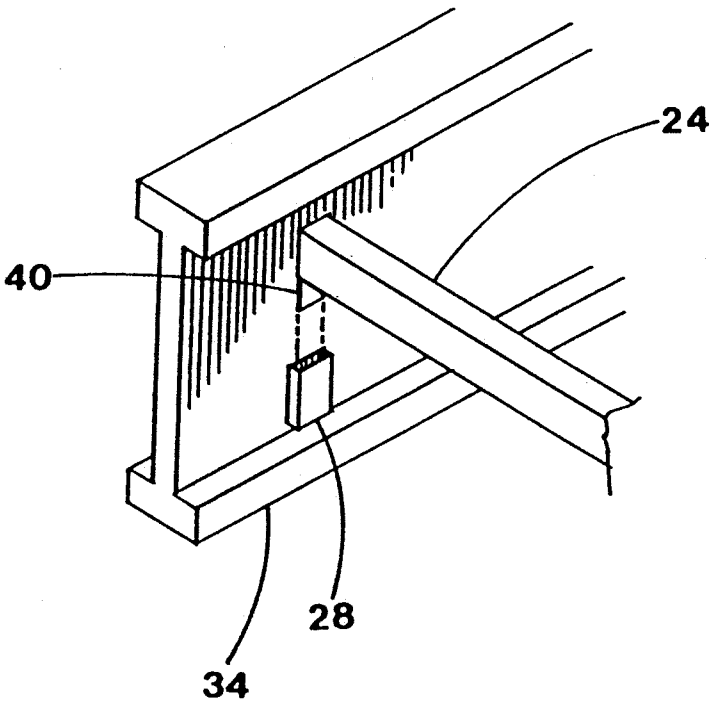
FIG. 9 is an exploded view of a purlin and its receiving hardware.
Figure 11:
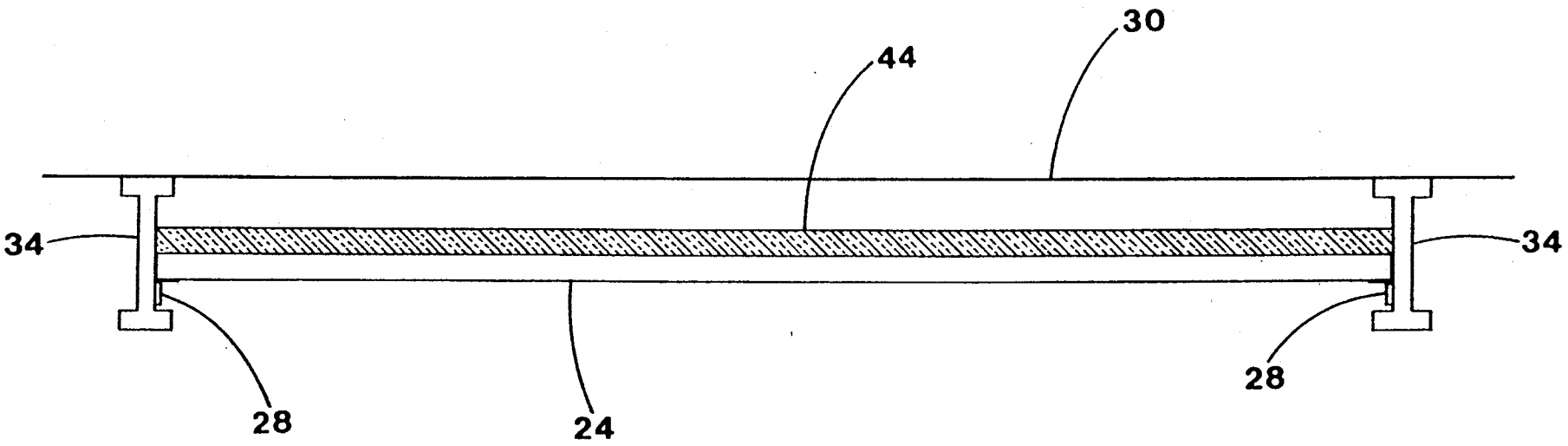
FIG. 11 is a cross sectional view of two overhead segments of two sequential web beam frames and a purlin spanning between them showing the location and support for the exterior covering material and an insulating liner.
Figure 12:
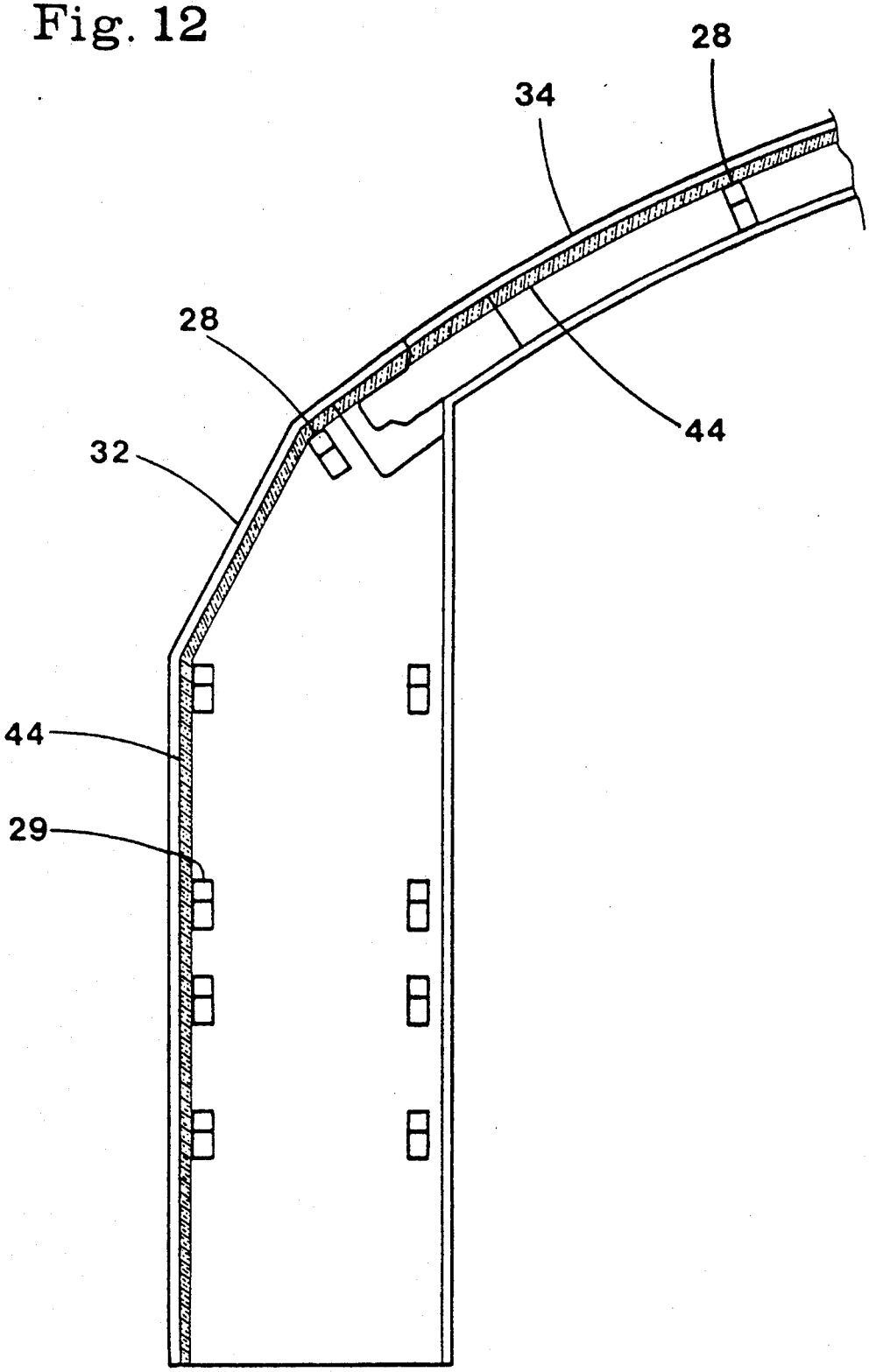
FIG. 12 shows a portion of an assembled web frame illustrating the location of the optional insulating liner as installed between the frames.
Figure 13:
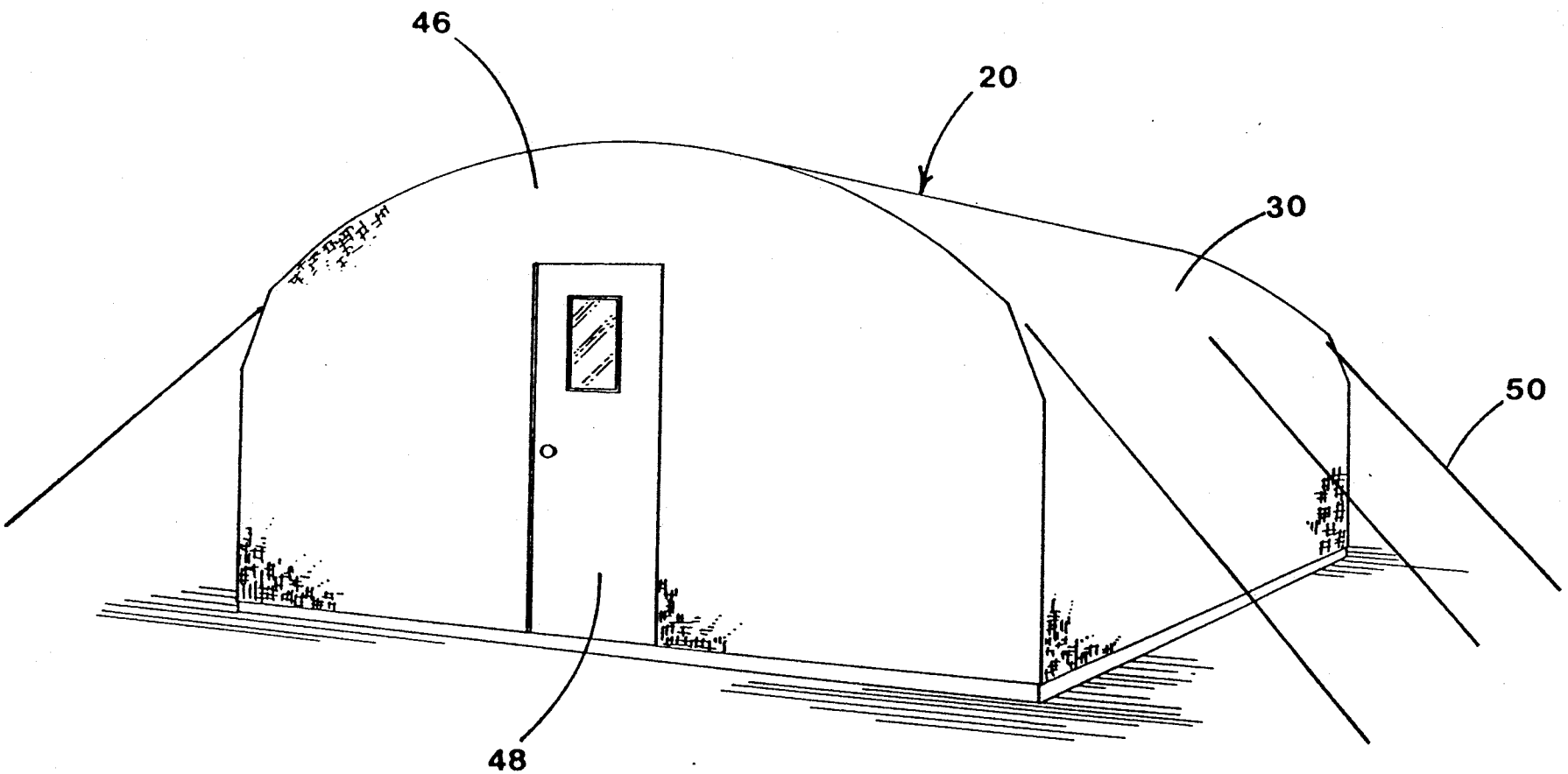
FIG. 13 is a perspective view of the structure in a fully assembled condition.

A typical embodiment of the present invention is illustrated in FIGS. 1 and 13 and generally designated by the number 20. A structure 20 is generally comprised of a multiple of individually collapsing web beam frames generally designated by the number 22, purlins 24, horizontal furnishing components 26, purlin receiving hardware 28, furnishing component receiving hardware 29, and an external covering means 30. FIG. 2 illustrates all of the components of a web beam frame 22 in an exploded view showing individual vertically oriented outer frame segments 32 and individual overhead frame segments 34 as well as mortise 36 and tenon 38 connecting means in an non assembled condition and typical locations for purlin receiving hardware 28 and furnishing components receiving hardware 29. It can be seen in FIGS. 1,2,3, and 4 that outer frame segments 32 have a width measured horizontally from the exterior most edge of outer segments 32, here defined by an outer flange 35, to the interior most edge of outer segments 32, here defined by an inner flange 33, wherein this horizontally measured width is made special or made significantly wide for the purpose of providing strong and convenient support for furnishing components 26. Furthermore it can best be seen in FIGS. 5,6,7,9,10 and 11 that components of frame 22 are generally comprised of an inner flange 33, an outer flange 35, and a webbing 39 between flanges 33 and 35. It is to be understood that while the primary components of frame 22 lend themselves particularly well to manufacture out of rigid sheet materials such as but not limited to plywood, fiberboard, foam core and honeycomb core panels, various metals etc., a number of other manufacturing techniques and materials may be suitable, including but not limited to plastic injection molding, fiberglass molding, extruded plastic, metal or tubular flanges and web or combinations thereof etc. It should also be noted that webbing 39 may be of either an open or solid construction. Solid webbing is shown here for simplicity. FIG. 3 shows a single fully assembled frame 22 illustrating mortise 36 and tenon 38 connecting means in an assembled condition. Purlin receiving hardware 28 and furnishing component receiving hardware 29 are located in corresponding locations on both side of frames 22. FIG. 4 is an interior perspective view of a typical furnishing configuration showing furnishing components 26 installed at various heights in receiving hardware 29. In FIGS. 1 through 4 receiving hardware 29 is shown at bench height, desk height, counter height and shelf height, however it is to be understood that receiving hardware of any type may be installed at any height on outer frame segments 32. In this embodiment furnishing components 26 shown in FIG. 4 are installed as shelves. FIG. 5 is an exploded view of mortise 36 and tenon 38 connecting means between outer frame segment 32 and overhead frame segment 34. It is to be understood that the specific mortise and tenon configuration shown here is only one of many suitable configurations and more generally only one of many suitable connecting means for the individual frame segments. Also shown in FIG. 5 is an exploded view of one end of a single purlin 24 with simple tab hardware 40 and corresponding receiving hardware 28 on outer frame segment 32. In this embodiment the purlin 24 to receiving hardware 28 assembly shown best in FIGS. 5,6,9,10 and 11 is a typical tab into slot connection with tabs 40 on either end of purlins 24, however it is to be understood that there are many suitable connecting hardware means for this assembly. FIG. 6 shows all components of FIG. 5 in an assembled condition. FIG. 7 is an exploded view of mortise 36 and tenon 38 connecting means of two overhead frame segments 34 of frame 22. FIG. 8 shows the same components of FIG. 7 in an assembled condition. FIG. 9 is an exploded view of one end of a single purlin 24 with simple tab hardware 40 and corresponding receiving hardware 28 on an overhead frame segment 34. FIG. 10 shows all components of FIG. 9 in an assembled condition. FIG. 11 is a cross sectional view of two sequential overhead frame segments 34 an d apurlin 24 installed between them showing the location and support for exterior flexible insulating liners 4. FIG. 12 shows a portion of an assembled frame 22 illustrating a typical location of optional insulating liner 44 as installed between frames. FIG. 13 is a perspective view of a structure 20 in a fully assembled condition showing exterior covering material 30, an end wall 46, access door means 48, and guy lines 50 for securing the structure to the ground. Exterior covering 30 may also be of any number of suitable materials either rigid or flexible and can best be chosen according to the specific climate and application for which the structure is used.

OPERATION

Accordingly it can be seen from the drawings that the invention is erectable into a temporary structure 20 shown in FIGS. 1 and 13 in a simple, fast and efficient manner as follows. Initially frames 22 are assembled from pairs of individual segments 32 and 34 as best shown in FIG. 2. The individual frame segments 32 and 34 are joined in the desired configuration best shown in FIG. 3 with corresponding and self aligning mortise 36 and tennon 38 connecting means for a fast and positive assembly. FIGS. 5 through 8 best show the self aligning mortise 36 and tennon 38 assembly configuration. Once assembled individually frames 22 are held upright in sequence while pulins 24, as in FIGS. 5,6,9, and 10, are inserted into the corresponding receiving hardware 28 on the opposing surfaces of each consecutive pair of frames 22. Furnishing components 26 best shown in FIGS. 1 and 4 may be installed with similar tab in slot or any other suitable hardware either at this time or at anytime after this including after the remainder of the assembly is complete. The flexible insulating liners 44 shown in FIGS. 11 and 12, which also may be installed either at this time or at anytime after the remainder of the assembly is complete, are installed in between frames 22 and a distance inside the outer perimeter of frames 22. This may be done by simply laying a width of the desired insulating material, such as REFLECTIX TM, a trademark of Reflectix Inc., roughly equivalent to the length of the purlins, across all of the purlins and outside of the furnishing components in between every two sequential frames. Thus insulating liners 44 are simply supported by purlins 24 and furnishing components 26. It should be noted that the available depth of the insulation cavity can be varied either by changing the location of purlin receiving hardware 28, thereby changing the distance between purlins 24 and exterior covering material 30, or by providing alternative support means for liners 44 underneath purlins 24 or on the interior surface of frames 22. Once frames 22 are erected with a sufficient number of purlins 24 installed in between them as in FIG. 1 then covering means 30 may be added to the structure including endwalls 46 and door means 48 shown in FIG. 13. Guy lines 50 shown in FIG. 13 may be attached for securing the structure to the ground.

Thus it can be seen that after the primary assembly is complete or at anytime while the structure 20 shown in FIGS. 1 and 13 is erect the user has the option of rearranging, removing or installing any desired furnishing component 26 in the desired location along either outside wall of the structure. It should be noted that the user also has the option of easily removing or replacing insulating liners 44 shown in FIGS. 11 and 12 while exterior covering means 30 is attached thereby being able to easily customize the type and depth of insulation according to changing conditions or applications.

SUMMARY, RAMIFICATIONS AND SCOPE

Thus the reader will see that the invention described herein provides an extremely simple and effective structure with many advantages made possible by the novel configuration of wide vertically oriented outer frame segments which provide both great resistance to shear stress on the structure while simultaneously providing a strong and convenient support structure for an easily customized interior furnishing system. The structure thereby allows the user to create an optimal use of available interior space for a great variety of applications without the need for transporting bulky independently supported furnishing. The structure can be made relatively light in weight yet strong enough to be used comfortably in harsh environments with heavy wind and snow loading conditions. The structure is easily assembled from a minimum number of parts with no special tools or equipment required and it can be easily manufactured from any of a wide variety of commonly available materials using a small number of patterns. Again it should be noted that the overall simplicity of this design is among the primary objectives of the invention and serves to enhance and facilitate the ease of assembly, the case of manufacture, and the reliability and ease of repair in the field.

While my above description contains many specificities, these should not be construed as limitations on the scope of the invention, but rather as an exemplification of one preferred embodiment thereof. Many other variations are possible. For example the web of the frames may be of open construction as in an open web truss or frame. Solid web construction is shown in the drawings for simplicity. Also the frames need not be of a true web beam truss construction. The presence of an inner or outer flange is not essential to the function of this invention. A rigid covering material could serve the function of the outer flange of the frames or the material used for the frames may not require the additional strength provided by inner and outer flanges. Other possible variations include an alternate number of frame segments. Single overhead segments may be used or three or more overhead segments may be used. Accordingly, the scope of the invention should be determined not by the embodiments illustrated, but by the appended claims and their legal equivalents.

I claim:

1. A portable collapsible building system comprising:

a building framework, an adaptable furnishing means supported by said framework and an exterior covering means supported by same said framework, said framework comprising a plurality of parallel frames, said frames comprising vertically oriented outer segments, overhead segments spanning between and being supported by said outer segments, said outer segments having a width measured horizontally from the exterior most edge of said outer segments to the interior most edge of said outer segments wherein said width is made special for the purpose of providing strong and convenient support for said furnishing means where said outer segments operate in pairs to support said furnishing means, said width being sufficient to substantially border said furnishing means along two opposing sides of said furnishing means when said furnishing means are installed between and supported by two consecutive said outer segments, said outer segments having support means for said furnishing means, said furnishing means being configured to fit substantially within the area directly between two consecutive said outer segments whereby said furnishing means can be installed to provide a useful surface area.

2. The building system of claim 1, and wherein said outer segments have support means at various heights for said furnishing means whereby said furnishing means can be optionally installed at various heights substantially between two consecutive said outer segments of two consecutive said frames.

3. The building system according to claim 2, and wherein said frames are individually collapsible into multiple detachable segments with connecting means for joining said segments into complete frames.

4. The building system according to claim 3, and wherein said connecting means for joining said detachable segments of said frames are substantially comprised of corresponding and self aligning mortise and tenon surfaces on the individual frame segments.

5. The building system according to claim 4, further including multiple rigid members serving as purlins which are attachable to said frames.

6. The building system according to claim 5, further including a flexible insulating lining means supported by said rigid members serving as purlins.

7. The building system according to claim 6, and wherein said frames are configured as web beam frames, said web beam frames comprising an inner flange and an outer flange and a web between said inner flange and said outer flange whereby said inner flange and said outer flange provide stiffness to said web.

8. The building system according to claim 4, and wherein said frames are configured as web beam frames, said web beam frames comprising an inner flange and an outer flange and a web between said inner flange and said outer flange whereby said inner flange and said outer flange provide stiffness to said web.

9. The building system according to claim 1, and wherein said frames are configured as web beam frames, said web beam frames comprising an inner flange and an outer flange and a web between said inner flange and said outer flange whereby said inner flange and said outer flange provide stiffness to said web.

* * * * *